US006050189A

United States Patent [19]

Junghans et al.

[11] Patent Number: 6,050,189

[45] Date of Patent: Apr. 18, 2000

[54] METHOD FOR MULTICOLOR PRINTING OF NONABSORBENT MATERIAL, AND A PRINTING PRESS FOR PRINTING IN ACCORDANCE WITH THE METHOD

[75] Inventors: Rudi Junghans, Wilhelmsfeld; Peter Stadler, Heidelberg, both of Germany; Emil Götz, Geroldswil, Switzerland

[73] Assignee: Heidelberger Druckmaschinen AG, Heidelberg, Germany

[21] Appl. No.: 09/023,954

[22] Filed: Feb. 17, 1998

[30] Foreign Application Priority Data

Feb. 17, 1997 [DE] Germany ..... 197 06 154
Nov. 13, 1997 [DE] Germany ..... 197 50 259

[51] Int. Cl.[7] ..... B41M 1/14; B41F 5/16; B41F 35/02; B41L 41/02

[52] U.S. Cl. ..... 101/211; 101/174; 101/423; 101/349.1; 101/181

[58] Field of Search ..... 101/181, 183, 101/450.1, 349.1, 350.1, 211, 174, 423, 348

[56] References Cited

U.S. PATENT DOCUMENTS

| | | | |
|---|---|---|---|
| 4,397,235 | 8/1983 | Fischer | 101/141 |
| 4,765,243 | 8/1988 | Schiefer et al. | 101/451 |
| 4,939,992 | 7/1990 | Bird . | |
| 5,651,316 | 7/1997 | DeMoore et al. | 101/183 |
| 5,699,740 | 12/1997 | Gelbart | 101/477 |

FOREIGN PATENT DOCUMENTS

| | | |
|---|---|---|
| 1 251 688 | 3/1989 | Canada . |
| 0 078 253 B1 | 5/1983 | European Pat. Off. . |
| 15 71 863 C3 | 1/1975 | Germany . |
| 26 08 661 B2 | 8/1978 | Germany . |
| 29 38 292 B2 | 7/1981 | Germany . |
| 31 13 407 A1 | 11/1982 | Germany . |
| 41 37 337 A1 | 5/1993 | Germany . |
| 41 42 421 A1 | 6/1993 | Germany . |
| 42 29 352 A1 | 4/1994 | Germany . |
| 43 11 834 A1 | 10/1994 | Germany . |
| 2 096 058 | 10/1982 | United Kingdom . |

OTHER PUBLICATIONS

Japanese Patent Abstract No. 4–185475 (A) (Yuasa), dated Jul. 2, 1992.

*Primary Examiner*—Kimberly R. Asher
*Attorney, Agent, or Firm*—Herbert L. Lerner; Laurence A. Greenberg; Werner H. Stemer

[57] ABSTRACT

A method for multicolor printing of stock in web or plate form and having a smooth, nonabsorbent surface, includes printing on the stock by the indirect flexographic printing process; assigning each color to be printed to a respective printing unit which includes an inking unit, a cylinder for a flexographic printing form, a transfer cylinder and a counterpressure cylinder; always drying the ink on the stock before passing the stock to the next printing unit; and removing ink located in indentations and on sides, respectively, of the printing surfaces of the flexographic printing form; and a printing press for printing in accordance with the method.

17 Claims, 4 Drawing Sheets

METHOD FOR MULTICOLOR PRINTING OF NONABSORBENT MATERIAL, AND A PRINTING PRESS FOR PRINTING IN ACCORDANCE WITH THE METHOD

BACKGROUND OF THE INVENTION

1. Field of the Invention

The invention relates to a method for multicolor printing of stock or printing materials which are in web or sheet or plate form and have a smooth, nonabsorbent surface, such as plastic or metal plates, foils, or plastic-coated papers, and so forth, and a printing press for printing in accordance with the foregoing method.

In the conventional wet offset method, such materials can be printed only with limitations. It would indeed be possible to print these materials by the waterless offset process. However, the silicone surface of the dry offset plates (Toray plates) is only conditionally resistant to the required UV inks. The service life of the plates is shortened by ultraviolet or UV inks. The vulnerability or sensitivity of the silicone layer of waterless offset plates is contradictory to the required UV inks and to the drying process or the process of anchoring the inks to the surface of the plastic material.

In multicolor wet on wet printing, on the other hand, it is not possible to achieve especially high quality with UV inks on plastic material.

The aforementioned materials are therefore generally printed at the present time by flexographic printing, sometimes also with inks that are cured with the aid of UV projectors immediately after the printing process. For example, the book entitled "Technik des Flexodrucks" [Flexographic Printing Technology] published in 1982 by DFTA-Flexodruck Fachgruppe e.V. discloses the printing of such cylindrical containers as cans, tubes, and so forth, in multiple colors with UV-curable inks by flexographic printing. The machine or press described in this book on page 12.7 thereof has a plurality of printing units having UV projectors disposed therebetween, and are said also to be capable of printing by the indirect letterpress method, i.e., the letterset process. Such machines are very expensive, however, because they are built only by special order and are not very worthy except for very large printing jobs and when they are in use very frequently.

Moreover, limits are also set to the print quality, due to the use of letterpress methods. One problem, for example, is that printing ink builds up on the flexographic printing form and collects in the indentations on the flexographic printing form, respectively, so that there are isolated instances of ink being transferred to nonprinting regions of the flexographic printing form.

German Patent 15 71 863 discloses a simple, direct letterpress method wherein the residual film of ink remaining after the printing operation is removed completely each time before the printing form is re-inked. The residual ink film is removed from the printing form via ink removal rollers and returned to the ink supply again. However, this German patent makes no reference to the problems which arise in multicolor printing especially on nonabsorbent surfaces.

Canadian Patent 1,251,688 describes a lithographic offset printing press with a short inking unit and a dampening unit, wherein excess ink is scraped from the wet offset plate with a doctor blade.

2. Summary of the Invention

It is accordingly an object of the invention to provide a method for multicolor printing of nonabsorbent material by which stock or printing materials in web or plate form with a nonabsorbent surface can be printed in multiple colors simply and economically with high quality, and to provide a printing press suitable for performing this method.

With the foregoing and other objects in view, there is provided, in accordance with one aspect of the invention, a method for multicolor printing of stock in web or plate form and having a smooth, nonabsorbent surface, which comprises printing on the stock by the indirect flexographic printing process, assigning each color to be printed to a respective printing unit which includes an inking unit, a cylinder for a flexographic printing form, a transfer cylinder and a counterpressure cylinder, always drying the ink on the stock before passing the stock to the next printing unit, and removing ink located in indentations and on sides, respectively, of the printing surfaces of the flexographic printing form.

In accordance with another mode, the method of the invention includes printing with UV-curable inks and, downstream of each printing unit, irradiating the printed stock with UV light.

In accordance with a further mode of the method of the invention, the printing form is a metal-lined flexographic printing plate.

In accordance with an added mode, the method of the invention includes applying the ink by a conventional offset inking unit.

In accordance with an additional mode, the method includes applying the ink with a short inking unit to the flexographic printing plate.

In accordance with yet another mode, the method of the invention includes applying the ink to the flexographic printing plate with a screen roller cooperating with a chamber doctor blade.

In accordance with yet a further mode, the method of the invention includes removing the ink in the indentations and on the sides, respectively, of the printing surfaces of the flexographic printing form and reapplying that ink as a thin film before each re-inking of the printing form.

In accordance with yet an additional mode, the method of the invention includes completely cleaning the flexographic printing form a multiplicity of times during an ongoing printing job.

In accordance with yet an added mode, the method of the invention includes maintaining the flexographic printing form in continuous contact with a soft roller during the printing process.

In accordance with another aspect of the invention, there is provided a printing press for multicolor printing of stock in web or plate form and having a smooth, nonabsorbent surface, comprising a plurality of individual printing units, respectively, associated with a single color, the printing units being arranged in rows and having at least one inking unit, one cylinder for a flexographic printing form, one transfer cylinder and one counterpressure cylinder, a plurality of drying devices for the printing ink, respectively, assigned to one printing unit, and a plurality of devices assigned to the flexographic printing forms for removing ink from the indentations and sides, respectively, of the printing surfaces of the applicable flexographic printing form, the ink-removing devices being actuatable for removing the ink continuously or repeatedly at short intervals during a printing job.

In accordance with another feature of the invention, the printing press includes a control system connected to the device for removing ink and having an input for introducing the cleaning intervals.

In accordance with a further feature of the invention, the drying devices include UV projectors.

In accordance with an additional feature of the invention, the printing press includes a wet offset printing press rebuilt for the letterset process, wherein a groove in the printing form cylinder for receiving the flexographic printing form is enlarged to between 1 and 2 mm, and into which, instead of the dampening units, one device for removing ink from the indentations and sides, respectively, of the flexographic printing form is built into each of the individual printing units.

In accordance with yet another feature of the invention, the device for removing the ink is a washing device.

In accordance with yet a further feature of the invention, the device for removing the ink is a roller with a soft, ink accepting surface installed instead of a dampening fluid applicator roller.

In accordance with a concomitant feature of the invention, the printing cylinders in each printing unit and the transfer cylinders between the printing units have at least twice the diameter of the printing form and transfer cylinders, respectively.

In this manner, it is possible to print on platelike plastic material, of the type used for check cards, telephone cards, chip cards, and so forth, quickly and inexpensively with a quality previously thought unattainable, because the printing press required for performing the method can be assembled by modifying printing units built in great numbers for wet offset printing. All that needs to be done is to change the depth of the recess in the plate cylinder from a typical value of 0.3 to 0.5 mm to a value of 1 to 2 mm, so that instead of the wet offset plates the flexographic printing plates, which are thicker, can be fastened thereon. Instead of the dampening unit which is otherwise customarily present, a device for removing ink from the indentations or sides of the printing surfaces of the flexographic printing plate is then installed: either a washing device, or a roller with a soft, ink-accepting surface provided instead of a dampening fluid applicator roller which is otherwise present. Finally, if UV-curable inks are used, suitable drying units, i.e., UV projectors suitably dimensioned with respect to power, can be installed in the printing unit.

By dispensing with dampening, stability in ongoing production printing is rapidly attained, and spoilage upon startup is drastically reduced which, for the relatively costly plastic materials makes for a substantial cost savings and improvement in quality.

The inking unit, conversely, can either be kept with a short inking unit or replaced with a screen roller which cooperates with a chamber doctor blade.

Depending upon the particular printing requirement, it may be expedient for the flexographic printing form to be cleaned repeatedly at relatively shorter or longer intervals during an ongoing printing job, or even before each re-inking operation, so as to assure always replicable conditions for every impression. It is therefore advantageous to provide a suitable control system for that purpose, into which the cleaning intervals can be input. In this way, the time needed to perform a printing job can be suitably optimized for the printing quality desired.

Especially whenever the ink residues are to be removed before each re-inking of the printing form, it is expedient to accomplish this with a soft roller which rests in continuous contact on the flexographic printing form and removes excess ink residues from the printing form, and then, after subsequent distribution by a second roller, re-applies the ink in a thin, even film.

Other features which are considered as characteristic for the invention are set forth in the appended claims.

Although the invention is illustrated and described herein as embodied in a method for multicolor printing of nonabsorbent material, and a printing press for printing in accordance with the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
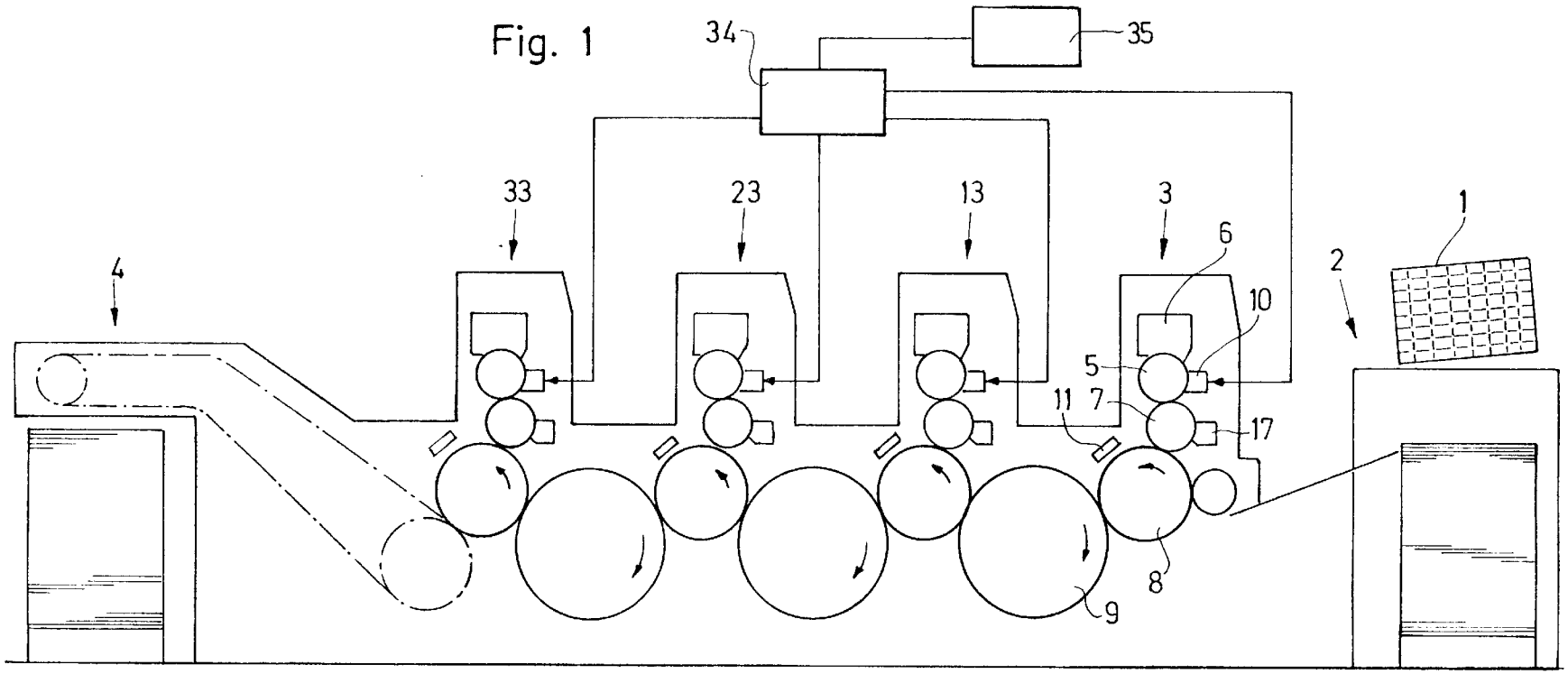
FIG. 1 is a greatly simplified diagrammatic side elevational view of a printing press suitable for performing the method of the invention.

Referring now to the drawings and, first, particularly to FIG. 1 thereof, there is shown therein a platelike plastic material 1 to be printed. It is formed of a polyethylene plate 0.8 mm thick and 31 cm×61 cm in size, from which, after the printing operation, thirty telephone cards will later be stamped out. In the same hereinafter described manner, however, it is also possible to print on printing stock of other material, such as polypropylene, polyamides, polyester, Hostaphan films or foils, aluminum vapor-deposited printing materials, and so forth.

The plates 1 are stacked in a feeder 2 and from there are delivered in a conventional manner to the first of what in the case at hand are four printing units, in line with one another and in unit construction. The four printing units 3, 13, 23 and 33 are all of identical construction and differ from one another only in the color that they print. Each printing unit has a printing form cylinder 5 over which an aluminum-lined 1.16 mm thick flexographic printing form 12 (note FIG. 5) is fastened. Such flexographic printing forms are sold under the trade name Nyloflex FAE-L by BASF, Ludwigshafen, Germany, for example. Because the printing unit 3 is a modified wet offset printing unit, and thus typically offset printing plates 0.3 mm thick are fastened to the plate cylinder 5 thereof, the recess in the cylinder 5 has been enlarged to suit the difference in thickness, and taking into account any underlays which may be used.

To the printing form cylinder or plate cylinder 5, there is assigned a previously existing inking unit 6, which is also suitable for the printing of wet offset inks. Such an inking unit is described, for example, in U.S. Pat. No. 5,388,514, and permits two modes of operation, either as a long inking unit or as a short inking unit, depending upon the type of printing job desired. For the coverings of the inking rollers, in any case, a quality is selected which permits printing with UV inks. These rollers are therefore mainly coated with polyurethane. A soft polyurethane coating having a thickness of 6 to 10 mm is suitable, and the polyurethane has a Shore A hardness of approximately 35.

Printing is performed cationically with UV flexographic printing inks, such as those in the Bargoflex 36-0 series of inks, or radically with 39-2 inks. Such inks are sold, for example, by SICPA-Arberg A.G., in Arberg, Switzerland. These inks have a viscosity of between 20 and 30 dP for the colored inks and, with respect to their flowability, are near the familiar range of present-day flexographic printing inks. Their somewhat higher viscosity and higher tackiness, compared to inks which contain solvents and/or water, assure an even, thin application of ink and a substantially lesser increase in tonal value. It is thus possible to use even very high-resolution printing blocks or plates, and the printing quality is assured to remain constant over the production time. The inks contain epoxy resins and are cured by UV radiation.

The printing unit 3 also has a transfer or rubber blanket cylinder 7, which takes the printed image from the flexographic printing form. Associated with the transfer cylinder 7 is a counterpressure or impression cylinder 8 having twice the diameter of the transfer or blanket cylinder 7, which ensures that the stiff plates 1 will not deform excessively as they pass through the printing press. The same effect is attained by a triple-size transfer cylinder 9, from which the printed plates 1 are transferred to the next printing unit 13.

Immediately after the printing in one of the four printing units 3, 13, 23, 33, the printed-on ink is cured by UV drying units 11 built into the printing units. The drying units 11 are UV mercury medium-pressure projectors with an output of approximately 150 watts per linear centimeter. The UV projectors 11 contain quartz-coated aluminum reflectors, which reflect the total UV component of the spectrum required for the curing, but eliminate the infrared component in the manner of cold-light mirrors, and thus assure a high UV radiation density with minimal heat stress on the printing material.

Instead of the dampening unit otherwise located in the printing unit, a washing device 10 is mounted on the plate cylinder 5. This washing device 10 is connected to a control system 34, to which the washing intervals, at which the flexographic printing form fastened to the plate cylinder 5 is repeatedly cleaned during an ongoing printing job, can be input via an input unit 35, so as to prevent the ink from building up on the flexographic printing form and in the indentations and on the sides between the raised, printing locations on the flexographic printing form, respectively.

When the plastic plates 1 are printed, they are accordingly printed in succession in the four printing units 3, 13, 23 and 33 in the colors black, cyan, magenta and yellow by indirect flexographic printing, i.e., by the letterset method, and the inks, respectively, are dried immediately after each printing stage. At the same time, at short intervals, such as every 4000 revolutions of the plate cylinder 5, the washing device 10 is activated and the flexographic printing form is cleaned of excess ink.

The fully printed and dry plates are then stacked as usual in the delivery 4 of the printing press.

The printing unit 3 shown on a larger scale in FIGS. 2 to 5 is modified somewhat over that of FIG. 1. Otherwise, however, those parts which remain the same are provided with like reference numerals and therefore need not be described again at this juncture.

Figure 2:
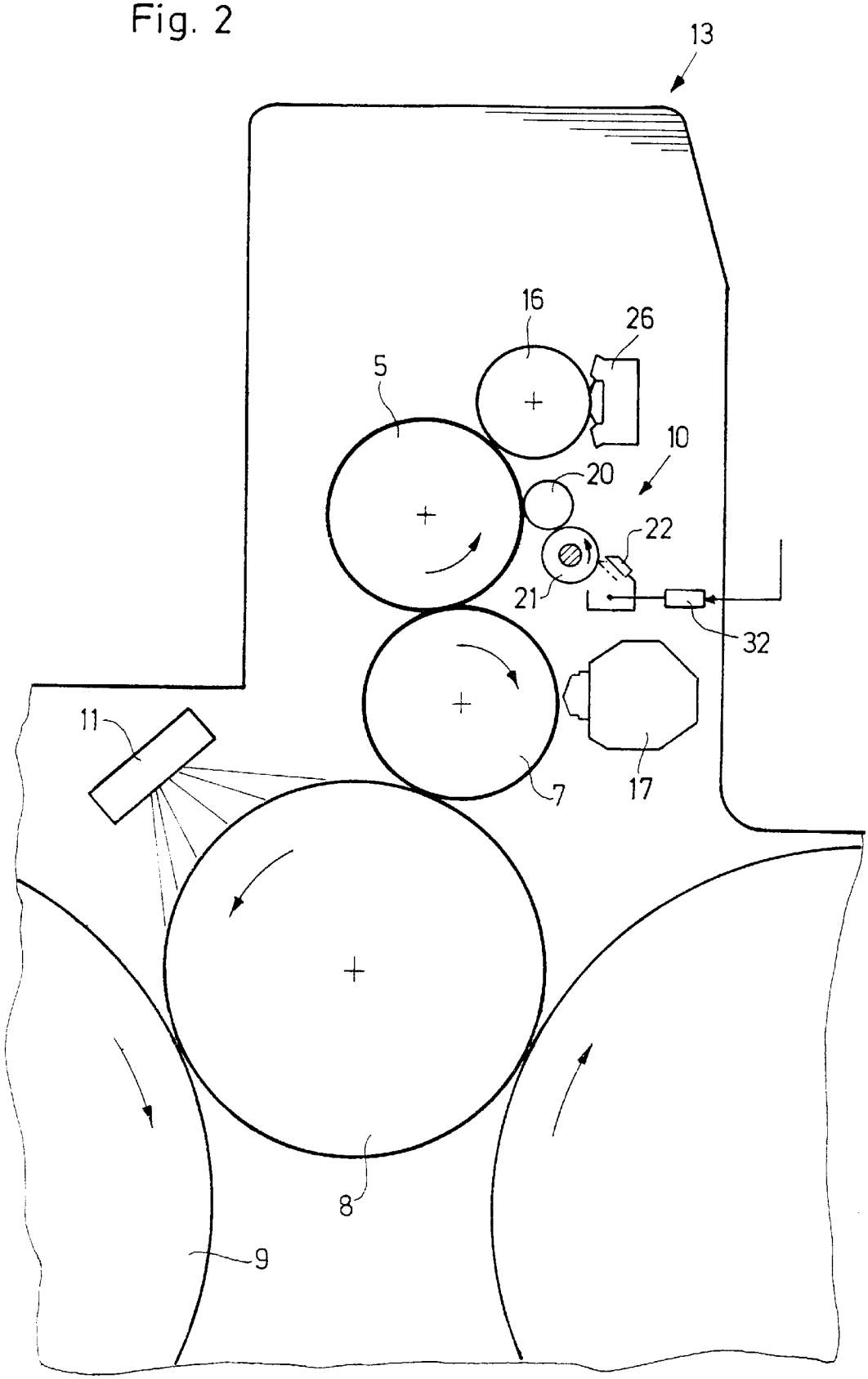
FIG. 2 is an enlarged fragmentary diagrammatic view of FIG. 1 showing one printing unit of the printing press of FIG. 1 in a somewhat modified version.
Figure 3:
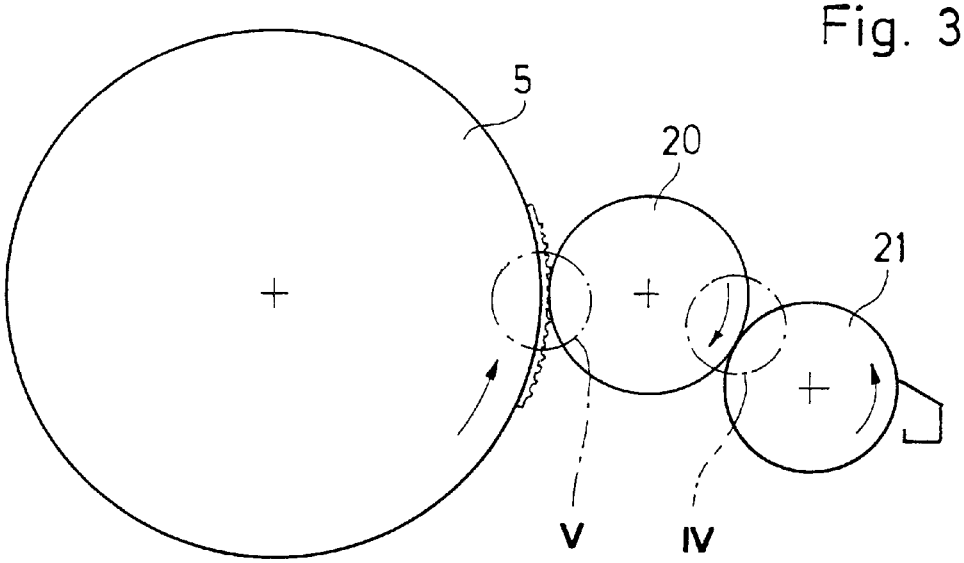
FIG. 3 is an enlarged fragmentary diagrammatic view of FIG. 2 showing a device for cleaning the flexographic printing form in accordance with the invention.
Figure 4:
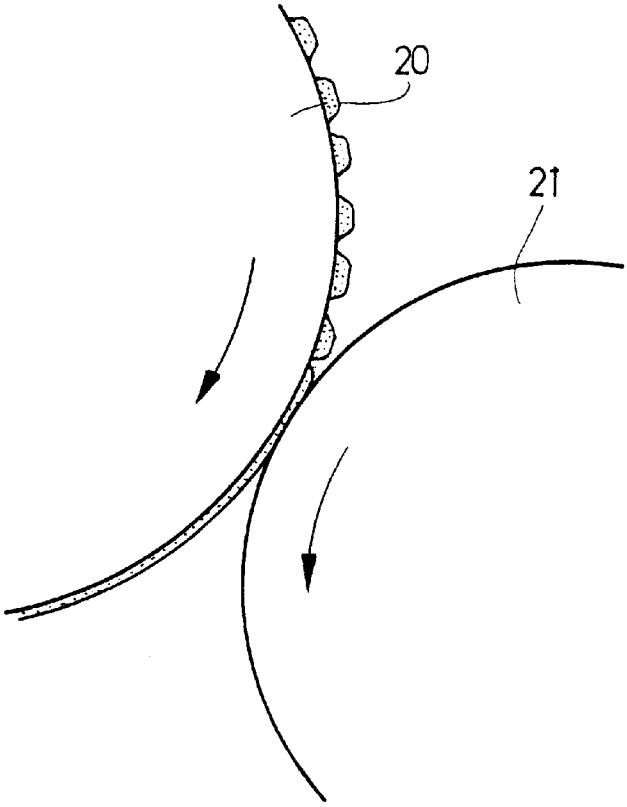
FIGS. 4 and 5 are further enlarged fragmentary diagrammatic views of FIG. 3 showing the encircled contact locations IV and V, respectively, between the rollers 20 and 21, on the one hand, and between the roller 20 and the flexographic printing form.

As is readily apparent from the enlarged view of FIG. 2, the printing unit 13 additionally includes a washing device 17, with the aid of which the rubber blanket fastened to the transfer or blanket cylinder 7 and the counterpressure or impression cylinder 8 can both be cleaned.

Figure 5:
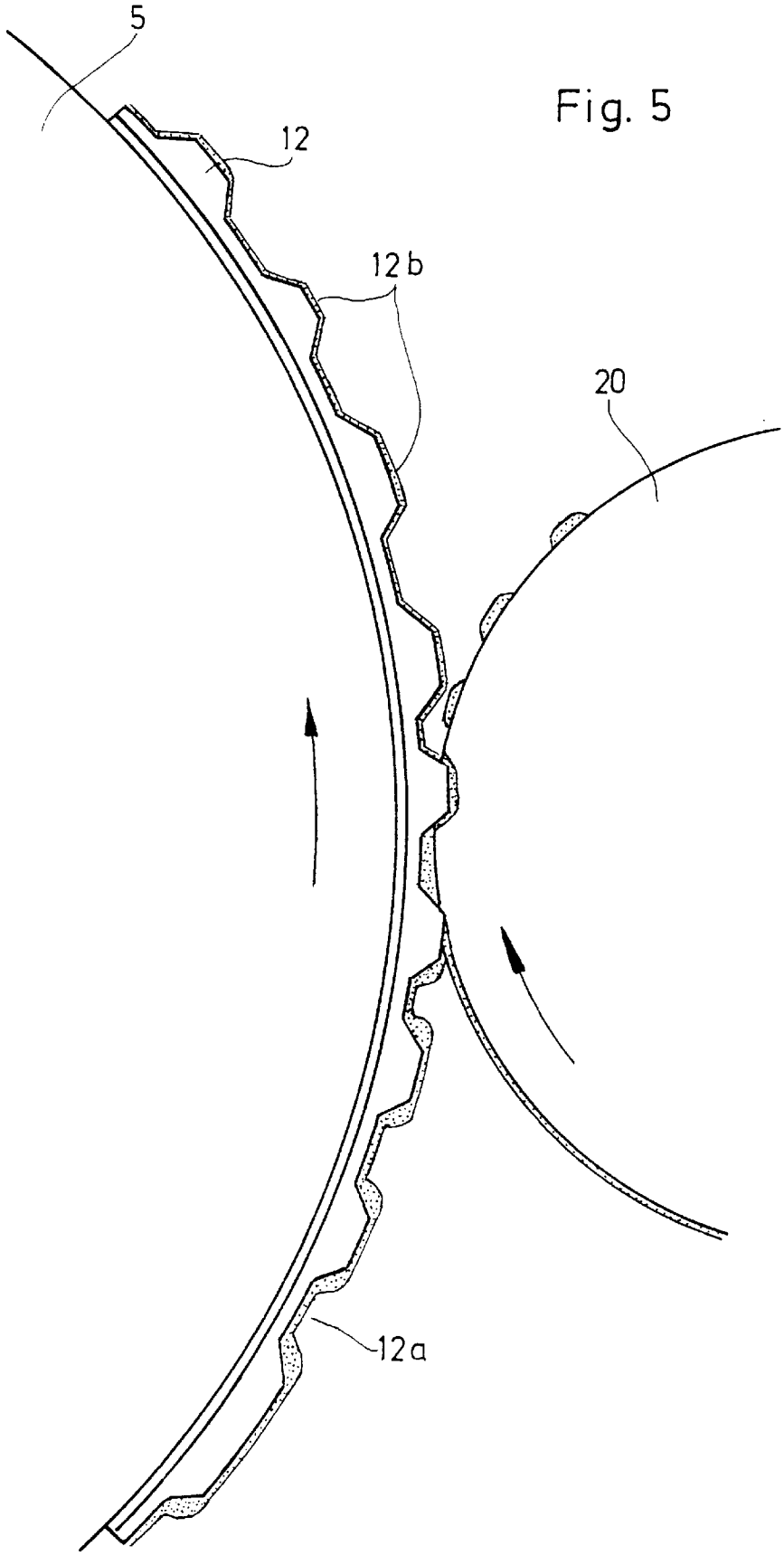

Instead of the conventional inking unit 6 (FIG. 1) optimized for wet offset printing, a screen roller 16 with a chamber doctor blade 26 is used to ink the flexographic printing form 12 (FIG. 5). Such inking units based upon a screen roller and chamber doctor blade are known per se and are therefore believed to require no further description.

Instead of a dampening unit, a roller 20 with a soft surface of synthetic rubber or polyurethane and a driven distributor roller 21 which rests thereon and laterally oscillated and which has a hard, ink-accepting surface are installed at the location whereat the dampening-fluid applicator roller and the distributor roller for the dampening agent are normally located. The rollers 20 and 21 revolve continuously; the roller 20 takes excess ink residues 12*a* (FIG. 5) which, during the printing process, form on the sides of the printing surfaces of the flexographic printing form, out of the indentations on the flexographic printing form 12 and then, after being distributed by the roller 21 (FIG. 4) re-applies them in a thin ink film (12*b*) onto the printing locations on the flexographic printing form 12 (FIG. 5). A doctor blade 22 can also be positioned against the roller 21 with the aid of an actuator 32 (FIG. 2), which is connected to the control system 34. In this manner, the raised locations of the flexographic printing forms, and the rollers 20 and 21 can be cleaned, the ink being taken from the synthetic-rubber or polyurethane-coated roller 20 and transferred to the roller 21, from the surface of which the doctor blade 22 then removes it.

We claim:

1. A method for multicolor printing of stock in web or plate form and having a smooth, nonabsorbent surface, which comprises:

printing at least four colors on the stock by the indirect flexographic printing process;

assigning each color to be printed to a respective printing unit which includes an inking unit, a cylinder having a flexographic printing form thereon, a transfer cylinder and a counterpressure cylinder;

always drying the ink on the stock before passing the stock to the next printing unit;

removing ink located in indentations and on sides, respectively, of the printing surfaces of the flexographic printing form using a roller installed at a location where a dampening fluid application roller is normally installed when using the respective printing unit for lithographic printing; and before each re-inking of the printing form, reapplying the removed ink as a thin film.

2. The method according to claim 1, which includes printing with UV-curable inks and, downstream of each printing unit, irradiating the printed stock with UV light.

3. The method according to claim 1, wherein the printing form is a metal-lined flexographic printing plate.

4. The method according to claim 1, wherein a conventional offset inking unit applies the ink.

5. The method according to claim 1, which includes applying the ink with a short inking unit to the flexographic printing form.

6. The method according to claim 1, which includes applying the ink to the flexographic printing form with a screen roller cooperating with a chamber doctor blade.

7. The method according to claim 1, which includes completely cleaning the flexographic printing form a multiplicity of times during an ongoing printing job.

8. The method according to claim 1, which comprises:

providing the roller with a soft surface; and maintaining the flexographic printing form in continuous contact with the soft surface of the roller during the printing process.

9. A method for multicolor printing of stock in web or plate form and having a smooth, nonabsorbent surface, which comprises:

printing at least four colors on the stock by the indirect flexographic printing process;

assigning each color to be printed to a respective printing unit which includes an inking unit, a cylinder having a flexographic printing form thereon, a transfer cylinder and a counterpressure cylinder;

always drying the ink on the stock before passing the stock to the next printing unit; and after every occurrence of a predetermined plurality of revolutions of the cylinder having a flexographic printing form thereon, activating a washing device for cleaning excess ink from the flexographic printing form repeatedly during an ongoing printing job.

10. A method for multicolor printing of stock in web or plate form and having a smooth, nonabsorbent surface, which comprises:

printing at least four colors on the stock by the indirect flexographic printing process;

providing a sheet-fed offset press including at least four printing units;

providing each one of the printing units with an inking unit, a cylinder having a flexographic printing form thereon, a transfer cylinder and a counterpressure cylinder;

assigning each one of the colors to be printed to a respective one of the printing units;

always drying the ink on the stock before passing the stock to the next printing unit;

removing ink located in indentations and on sides, respectively, of the printing surfaces of the flexographic printing form using a roller installed at a location where a dampening fluid application roller is normally installed when using the respective printing unit for lithographic printing; and before each re-inking of the printing form, reapplying the removed ink as a thin film.

11. The method according to claim 10, which comprises printing with UV-curable inks and, downstream of each printing unit, irradiating the printed stock with UV light.

12. The method according to claim 10, wherein the printing form is a metal-lined flexographic printing plate.

13. The method according to claim 10, wherein a conventional offset inking unit applies the ink.

14. The method according to claim 10, which comprises applying the ink with a short inking unit to the flexographic printing form.

15. The method according to claim 10, which comprises applying the ink to the flexographic printing form with a screen roller cooperating with a chamber doctor blade.

16. The method according to claim 10, which comprises completely cleaning the flexographic printing form a multiplicity of times during an ongoing printing job.

17. The method according to claim 10, which comprises:

providing the roller with a soft surface; and maintaining the flexographic printing form in continuous contact with the soft surface of the roller during the printing process.

* * * * *